United States Patent [19]

Werner

[11] Patent Number: 4,873,860

[45] Date of Patent: Oct. 17, 1989

[54] LIFTING BEAM ASSEMBLY FOR A FORMING PRESS

[75] Inventor: Eberhard Werner, Leverkusen, Fed. Rep. of Germany

[73] Assignee: Eumuco Aktiengesellschaft Für Maschinenbau, Leverkusen, Fed. Rep. of Germany

[21] Appl. No.: 86,531

[22] Filed: Aug. 18, 1987

[30] Foreign Application Priority Data

Feb. 26, 1987 [DE] Fed. Rep. of Germany ..... 3706160

[51] Int. Cl.[4] ..... B21J 13/08

[52] U.S. Cl. ..... 72/405; 72/421; 198/621

[58] Field of Search ..... 72/405, 421; 198/621, 198/774; 414/750, 751

[56] References Cited

U.S. PATENT DOCUMENTS

| | | | |
|---|---|---|---|
| 3,456,814 | 7/1969 | Bautz | 198/621 |
| 3,655,070 | 4/1972 | Haydu | 198/621 |
| 3,760,957 | 9/1973 | Berger | 72/405 |
| 4,462,521 | 7/1984 | Takagi | 198/621 |
| 4,517,853 | 5/1985 | Tani et al. | 414/750 |

*Primary Examiner*—Daniel C. Crane
*Attorney, Agent, or Firm*—Neil F. Markva

[57] ABSTRACT

The lifting beam assembly for transporting workpieces from work station to work station in a forming press includes a pair of transport beam members for grasping workpieces to be transported within the forming press. A first drive mechanism executes vertical movement to raise and lower the transport beam members. A second drive mechanism executes longitudinal movement of the transport beam members in a direction parallel to the direction traveled from work station to work station. A third drive mechanism executes transverse movement of the transport beam members. Each of the three drive mechanisms include movement actuating devices for effecting the respective vertical, longitudinal and transverse movements. An actuating shaft is secured at one end thereof for hydraulic actuation by an electro-hydraulic booster. It is coupled at the other end thereof to the movement actuating device for effecting the particular respective movement of the transport beam members. Various features of the individual portions of the structure are also set forth.

14 Claims, 4 Drawing Sheets

70
72
71
82
78
85
75
80
84
77
76
79
74a
83
78
81
74
73
74b

LIFTING BEAM ASSEMBLY FOR A FORMING PRESS

FIELD OF THE INVENTION

The invention relates to a lifting beam assembly for transporting workpieces from work station to work station in a forming press. More particularly, the invention is directed to a lifting beam assembly for mechanical and hydraulic drop forging presses, eccentric presses, wedge presses and the like.

BACKGROUND OF THE INVENTION

Such lifting beam automatics or assemblies are known and include transport beams which grasp workpieces between them and execute a longitudinal movement, a lifting and lowering vertical movement and a transverse movement. Gear devices controlled by a switching device are used to effect the desired movement.

In known forming presses having automatic workpiece transportation, the drive mechanisms were arranged below the forging dies and to the left and to the right of the press stands. Drop forging presses for massive forming of parts in the warm state resulted in the forging dies and the drive mechanisms of the lifting beam assembly to be contaminated by forging scales and the like. To avoid such contamination, the automatic workpiece transportation apparatus was then designed for disposition above the forging die tools. Transport arms were suspended above the tools for supporting the transport beams used to grasp the workpieces.

A known mechanical linkage system including cam controls, toothed wheels and racks, and connection shafts having considerable dimensions serves to drive the movements of the transport beams in three different directions. While such a prior art mechanically operated lifting beam assembly acts reliably at the right time, such device is extremely expensive and takes up much operating space. The gears usually have a central electrical drive mechanism for all three rotatable movement shafts.

The rotational movement produced by the electrical drive mechanism is converted into translatory movement via intermediate gears, levers, cam disks, linkage systems and the like. In a known electrical drive mechanism, two gear boxes are required on respective exteriors of the press and must be mechanically synchronized with respect to each other. Such an arrangement results in a very long resilient gear chain with much play at the articulated points of the individual gear members providing an insufficiently rigid connection between the central drive and the individual movement shafts. Consequently, desired high lift-frequencies can only be utilized in an insufficient manner because of the inherent vibration in the system which allows only comparatively low speeds and the positioning accuracy in the individual movement shafts is inadequate.

The lacking flexibility of the known system viz-a-viz changes of parameters must be regarded as a further crucial disadvantage. Changes in the magnitude of movement coordination of the individual movement shafts with respect to each other and variations of speeds of movement in the individual movement shafts can only be realized at considerable expense. Such disadvantages have been endured because of the certainty of the temporarily consecutive sequences of movement of the various operations. However, with the need to adapt such lifting beam assemblies to constantly changing and smaller lot sizes of workpieces, such aggravating disadvantages can no longer be sustained.

Manipulators are known to have linkage mechanisms for carrying out various sequential operations equipped with separate electrical drive mechanisms for the individual movements. However, using electric drives for lifting beam assemblies has special difficulties. The lifting beam assembly for a drop forging press must necessarily have a sufficiently robust construction to handle the workpieces being acted upon. Consequently, the acting shafts for effectuating the mechanical movement of the lifting beam assembly must necessarily have comparatively large dimensions. Thus, individual drives for each of the movements must have sufficiently great adjusting forces to produce the controlled, fast, and at the same time harmonic movement of the individual drives. Furthermore, such individual drives must be capable of being accommodated in a specially narrowly restricted construction area. Electrical drive mechanisms are not suitable for this because of an inadequate ratio of capacity to structural volume.

SUMMARY OF THE INVENTION

The primary object of the invention is to provide a lifting beam assembly for a massive forming machine which is more flexible, simple and dynamic inuse, construction and mode of control.

Another object of the invention is to provide a lifting beam assembly capable of handling different kinds of workpieces on one and same forming machine.

A still further object of the invention is to provide a lifting beam assembly having individual shafts used to effect different magnitudes of movement and sequences of movement for the transfer beam mechanism.

The lifting beam automatic or assembly as described herein includes a separate drive apparatus for effecting each of the vertical, longitudinal and transverse movements of transport beam means for moving workpieces from one work station to the next in a forming press. Each of the individual drive mechanisms is driven by an actuating shaft having an articulated connection at one end thereof. The shaft is connected at its other end thereof to a piston operating in a electro-hydraulic booster device. In other words, each of the three actuating shafts is an output shaft of an electro-hydraulic booster hydraulically actuated through the piston within the hydraulic cylinder. Each actuating shaft effects the respective longitudinal, vertical and transverse opening and closing movements of the transport beams of the lifting beam assembly or automatic.

The lifting beam assembly of the invention includes machine frame mounting units or devices including a support structure having pivotally mounted swing arms which pivot in a direction of transportation of the lifting transport beams. Stilts are pivotally mounted to the support structure and may be swung in a transverse direction with respect to the transport beams. The stilts support the transport beams and are connected with each other through a diagonal guide rod.

According to another feature of the invention, the transport beam mounting structures include at least one guide which extends vertically and along which a slide member is displaceably mounted. The actuating shaft connected to a electro-hydraulic booster is coupled to the slide member to effect vertical up and down movement to the transport beams.

Another actuating shaft is connected to a further electro-hydraulic booster and effects longitudinal movement to the transport beams by being coupled to swing arms pivotally mounted to the support structure.

A third actuating shaft connected to the piston of a electro-hydraulic booster is in articulated connection to a linkage mechanism for opening and closing a pair of transport beam members with respect to each other. Thus, the third actuating shaft effects the opening and closing movement of the lifting beams with the linkage mechanism including an extension means associated with one of the stilts pivotally mounted to the support structure. As the output shaft of each electro-hydraulic booster coincides with actuating shaft, an essential simplification of control of the actuating shaft for carrying out the individual operations is produced.

A further feature of the invention includes separate drive means for effecting the vertical movement of the transport beams and the transverse movement of opening and closing a pair of beams with respect to each other at each end of the transport beams. Thus, a pair of drive mechanisms is located on each side of the lifting beam assembly. The drive mechanism for effecting the longitudinal movement of the transport beams is located on only one side of the assembly. Synchronization of the drive mechanisms located at either end of the transport beams is effected by the electrical portion of the respective boosters. This represents an essential simplification in the construction of the lifting beam assembly.

A still further feature of the invention includes transport beam mounting units for the drive mechanisms located at either end of the transport beams hingedly connected to the forming press frame structure. Thus, the mounting units may be swung away from the machine frame to provide access to the tools of the forming press and to use the lifting beam assembly with different machines having the appropriate connections disposed on their respective frame structures.

An electro-hydraulic booster is advantageously used as a regulator with a follow-up regulating valve and an electric rated value selection through an electric motor, a hydraulic valve, a hydraulic drive and a mechanical actual value feedback.

ADVANTAGES OF THE INVENTION

The lifting beam assembly of the invention has a comparatively short gear chain. Many intermediate parts associated with the previous drive assembly mechanisms for lifting beam assemblies have been omitted. Very large forces can be exerted on a very small area because of the interplay of the electrical control for the hydraulic working portion of the booster. The hydraulic regulator operates powerfully and at the same time sensitively and in a very lively manner. This makes it possible to control the dynamic lifting and moving processes of the lifting beam assembly in a very precise manner.

With the drive mechanism for a lifting beam assembly according the invention, the whole assembly operation can be controlled more easily and quickly. The range of application for the lifting beam assembly is essentially wider and more universal. Change-overs are more simple and quicker to carry out. Thus, the lifting beam assembly can handle workpieces of another type on the same machine without structural modification.

By eliminating the necessity to rebuild a mechanically operating lifting beam automatic as in the prior art, the particular forming press no longer need be limited to handling just one certain kind of workpiece. Greater flexibility and adaptability of the lifting beam assembly to constantly changing tasks of the working, forming press is obtained.

The lifting beam assembly of the invention provides a high dynamic response with a shorter gear chain resulting in a reduced impairment of operation through inertial forces. Thus, shorter cycle times and considerably improved positioning accuracy of the workpieces to be transported are possible with the lifting beam assembly of the present invention.

BRIEF DESCRIPTION OF DRAWINGS

Other objects of this invention will appear in the following description and appended claims, reference being made to the accompanying drawings forming a part of the specification wherein like reference characters designate corresponding parts in the several views.

DETAILED DESCRIPTION

Figure 1:
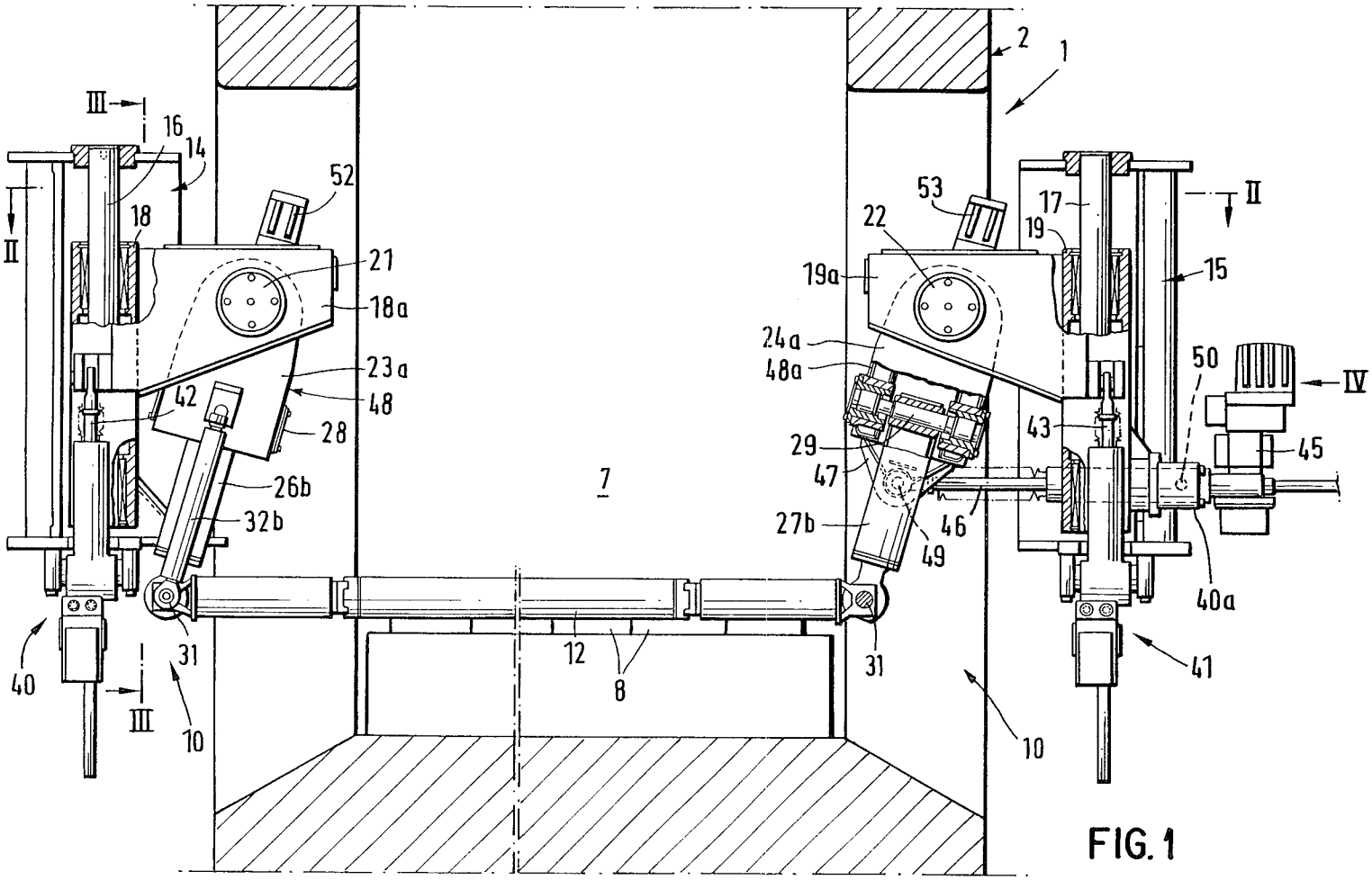
FIG. 1 is a front elevational view, partly in section, of a lifting beam assembly according to the invention in a forming press shown in section along line I—I of FIG. 2.

A forming press, generally designated 1, includes a press stand or frame structure 2 having four columns 3, 4, 5 and 6. Location 7 is where upper tools are secured to a ram (not shown) and cooperate with lower forging dies 8 between columns 3, 4, 5 and 6. Lifting beam automatic or assembly, generally designated 10, is fitted on forming press 1 to effect automatic workpiece transportation along the lower forging dies 8.

Lifting beam assembly 10 has transport beams 11 and 12 which extend laterally and at the height of lower forging dies 8. Transport beams 11 and 12 are provided in a known manner with grippers (not shown) directed to the central longitudinal plane of forming press 1. The construction of the grippers is determined by the particular shape of the workpiece being transported. The processing of the workpiece takes place with the help of several work stations arranged in the longitudinal direction of forming press 1. To effect movement of the workpiece from work station to work station, transport beams 11 and 12 and the grippers secured thereto execute a longitudinal movement, a lifting and lowering vertical movement, and a transverse movement to and from each other to effect an opening and closing operation.

Figure 3:
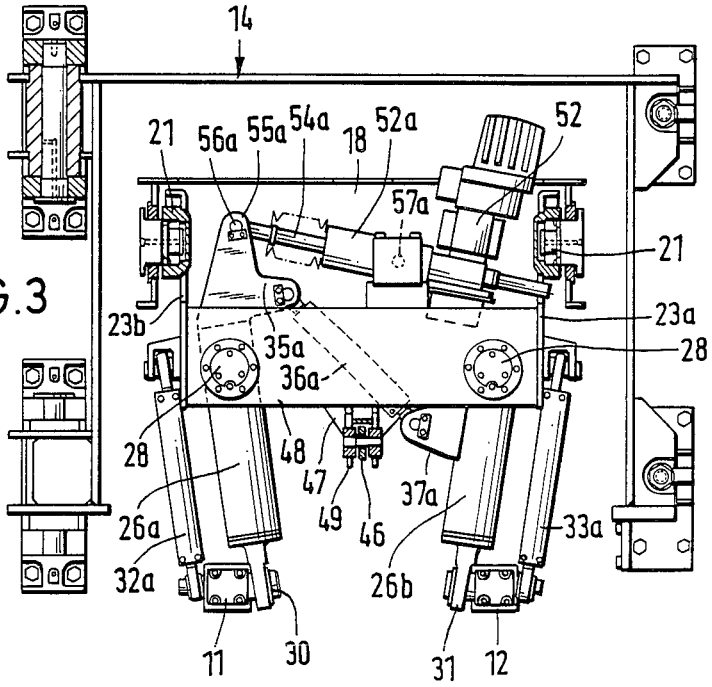
FIG. 3 is a sectional view of the lifting beam assembly along line III—III of FIG. 1 showing the detail of the apparatus for opening and closing the transport beams.
Figure 4:
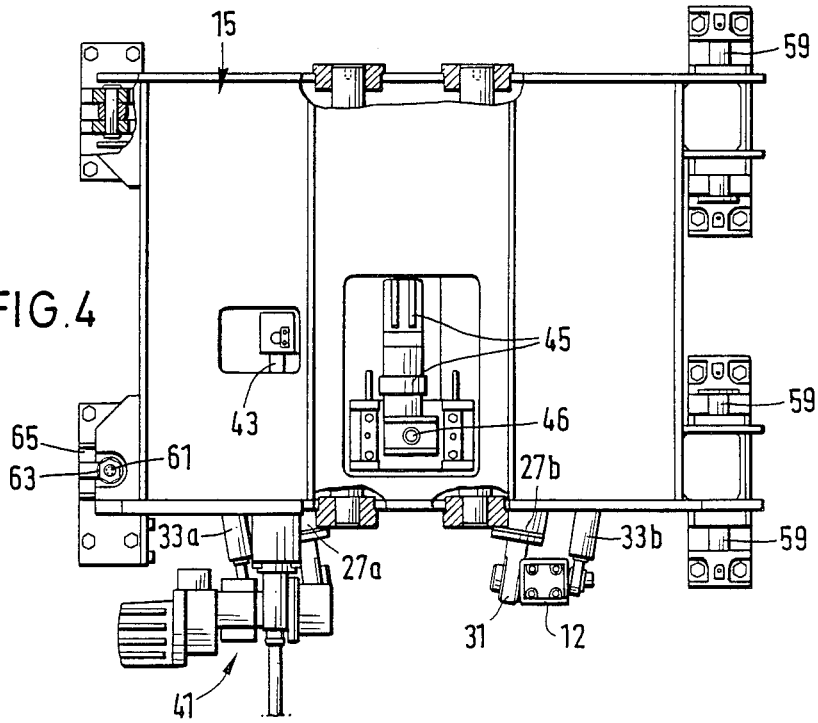
FIG. 4 is an elevational view, partly in section, of the lifting beam assembly in the direction of Arrow IV of FIG. 1.

Mounting units 14 and 15 are arranged laterally on machine frame columns 3, 5 and 4, 6, at respective ends of transport beams 11 and 12. Mounting units 14 and 15 include column pairs 16 and 17 on which slide members 18 and 19 are displaceably mounted as shown. Swing arms **23*a*, 23*b* and 24*a*, 24*b* are pivotally mounted about respective bearing journals 21 and 22 on slide support arms or members 18*a* and 19*a*. Stilts 26*a* and 26*b* are pivotally mounted about shafts 28** disposed on swing arms 23*a*, 23*b* as shown in FIG. 3 and stilts 27*a* and 27*b* are pivotally mounted about shafts 29 disposed on swing arms 24*a*, 24*b*.

Stilts 26*a* and 27*a* are connected in an articulated manner with transport beam 11 via articulated, bearing connections 30. Stilts 26*b* and 27*b* have articulated, connections 31 at opposite ends of transport beam 12.

Guide rod arms 32*a* and 32*b* are disposed parallel to respective stilts 26*a* and 26*b* while guide rod arms 33*a* and 33*b* extend parallel to respective stilts 27*a* and 27*b*. Such guide rod arms 32*a*, 32*b* and 33*a*, 33*b* insure a coordinated movement for guiding transport beams 11 and 12 in a parallel manner. Stilts 26*a*, 26*b* and 27*a*, 27*b* with appertaining respective guide rods 32*a*, 32*b* and 33*a*, 33*b* cause the opening and closing movement of transport beams 11 and 12 together with grippers (not shown) secured thereto.

Each pair of stilts 26*a*, 26*b* and 27*a*, 27*b* are connected to each other. An example of this connection is shown in FIG. 3 with respect to stilt pair 26*a*, 26*b*. An extension 35*a* at the upper end of stilt 26*a* passes beyond the center of rotation for shaft 28. A diagonally extending guide rod 36*a* is connected at one end to extension 35*a* and at the other end thereof to an extension 37*a* fixed to opposite stilt 26*b*.

Stilt 26*a* is connected to beam 11 and stilt 26*b* is connected to transport beam 12. Extension 37*a* on stilt 26*b* is disposed underneath the axis of rotation for stilt 26*b* so that upon actuation of one stilt, the opposite stilt must execute the same opening or closing moment for the transport beams 11 and 12. The stilts 27*a* and 27*b* at the other ends of beams 11 and 12 are connected to each other in an articulated manner as the just described stilts 26*a* and 26*b*.

Electro-hydraulic boosters 40 and 41 have respective output actuating rods 42 and 43 pivotally connected to slide members 18 and 19 for effecting movement in a vertical direction as shown. Upon operating of boosters 40 and 41, actuating rods 42 and 43 are adjusted in their longitudinal direction. As each slide member 18 and 19 is displaced in height, the appertaining swing arms 23*a*, 23*b* and 24*a*, 24*b* carry transport beams 11 and 12 up or down in a vertical adjustment. The electronic portion of boosters 40 and 41 enables synchronization to the movement of adjustment for the respective ends of transport beams 11 and 12.

Electro-hydraulic booster 45 drives transport beams 11 and 12 back-and-forth in a horizontal, longitudinal direction thereby controlling movement of the grippers associated therewith. Cross-traverse member 48*a* extends between fixedly secured swing arms 24*a*, 24*b* and carries shafts 29 about which stilts 27*a* and 27*b* pivot. Articulation connection 49 couples one end of output actuating rod 46 to an extension 47 of cross-traverse member 48.

Booster 45 longitudinally drives output actuating rod 46 to move swing arms 24*a*, 24*b*. Swing arms 23*a*, 23*b* move in synchronization with swing arms 24*a*, 24*b* via the path of transportation of transport beams 11 and 12. Housing 45*a* of booster 45 is rotatably mounted about cross journal 50. In the assembly of the invention, one booster on one side of the lifting beam assembly 10 is sufficient for effecting movement of transport beams 11 and 12 in their longitudinal direction.

Respective boosters 52 and 53 effect opening and closing of stilt pairs 26*a*, 26*b*, on one side, and 27*a*, 27*b* on the other side of assembly 10. Articulated connection 56*a* couples the outer end of output actuating rod 54*a* of booster 52 to an extension 55*a* of stilt 26*a*. As booster 52 adjusts output actuating rod 54*a* in the longitudinal direction, stilt 26*a* is moved in the direction of the central plane of lifting beam assembly 10. When rod 54*a* moves inwardly with respect to booster 52, stilt 26*a* moves outwardly with respect to the central plane of lifting beam assembly 10. At the same time, stilt 26*b* moves outwardly via diagonally extending guide rod 36. Thus, as rod 54*a* moves inwardly and outwardly with respect to booster 52, transport beams 11 and 12 execute an opening and closing movement with respect to each other.

Figure 2:
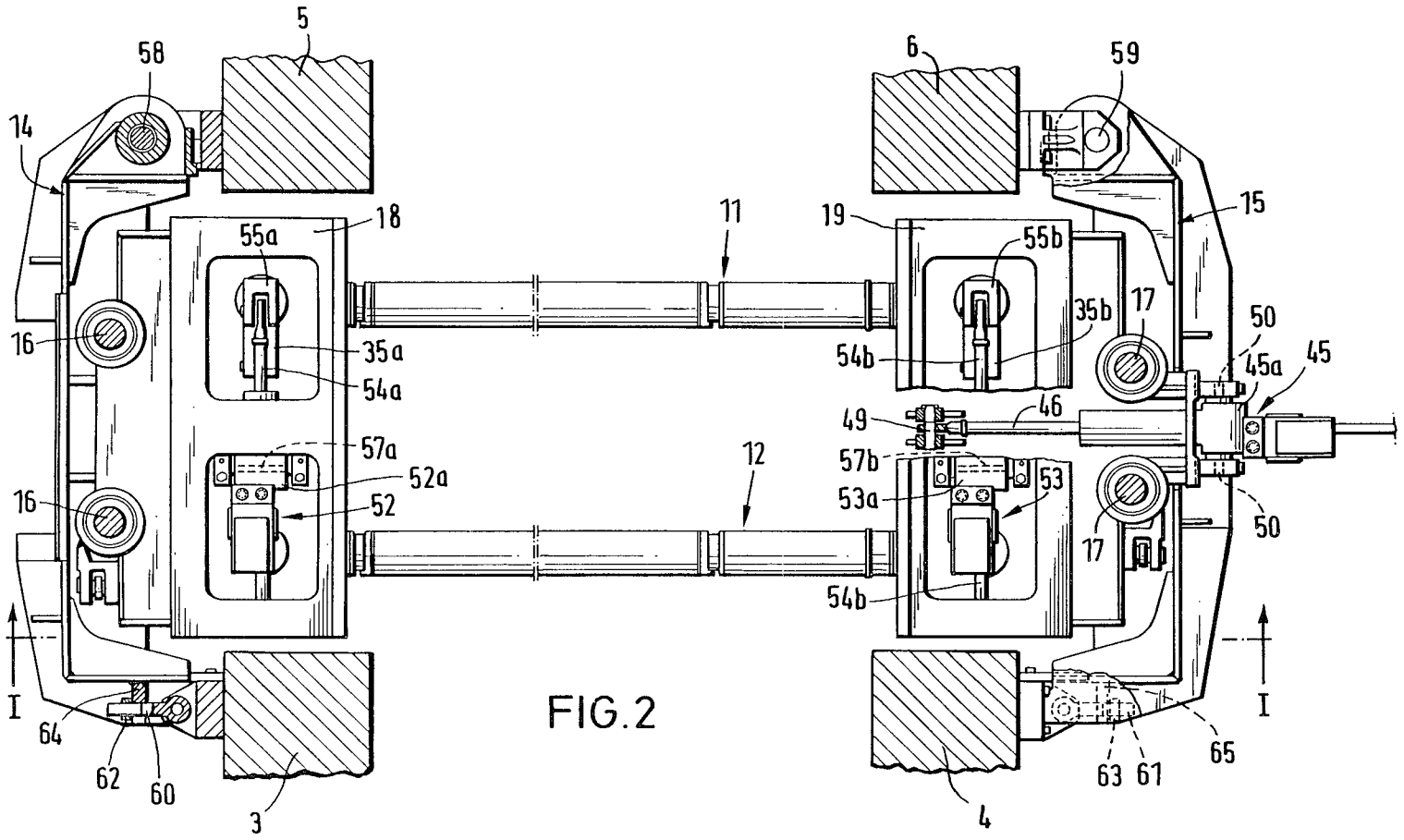
FIG. 2 is a sectional of the lifting beam assembly along line II—II of FIG. 1.

Booster 53 operating on stilts 27*a*, 27*b* at the opposite end of beams 11 and 12 is in synchronization with booster 52. Movement synchronization by boosters 52 and 53 is effected via electronic circuitry in the respective boosters. Housings 52*a* and 53*a* of respective boosters 52 and 53 pivot about cross journals 57*a* and 57*b*. As evident in the drawings of FIGS. 1, 2 and 3, boosters 52 and 53 are mounted to swing with respective swing arms 23*a*, 23*b*, and 24*a*, 24*b* while adjusting rods 54*a* and 54*b*.

The described construction of the separate drive means for lifting beam assembly 10 allows mounting units 14 and 15 to be arranged in a collapsible manner on the machine frame structure 2. The rear portions of mounting units 14 and 15 are hingedly mounted on vertical bolts 58 and 59. The front portion of mounting units 14 and 15 are secured by respective swing bolts 60 and 61 with nuts 62 and 63 which grip behind fixed shackles 64 and 65 as shown.

Upon removal of transport beams 11 and 12, mounting units 14 and 15 may be swung outwardly around the respective vertical hinge bolts 58 and 59. This provides good access to the sides of forming press 1 and to all parts fitted on mounting units 14 and 15 such as those driven by electro-hydraulic boosters 40, 41, 45, 52 and 53. The particular construction of lifting beam assembly 10 provides a disassembly feature so that it may be used on other machines or presses without difficulty.

Figure 5:
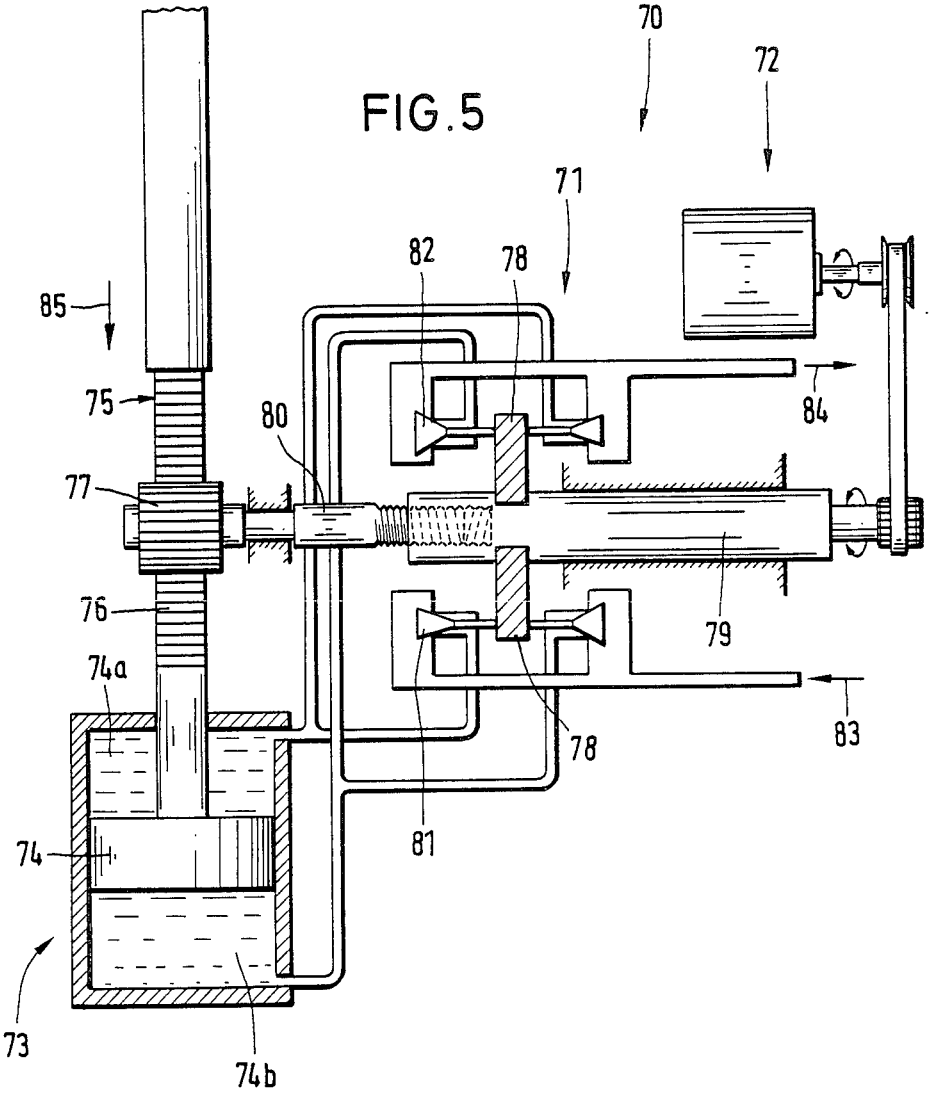
FIG. 5 is a diagrammatic view, partly in section, of a system outline of the invention for an electro-hydraulic booster.

FIG. 5 shows a diagrammatic system outline of a electro-hydraulically operating booster used to drive the movement actuating means of assembly 10. A regulator, generally designated 70, includes a follow-up directional control valve 71 for the hydraulic portion of regulator 70. In this embodiment, an electric motor 72 is a stepping or servo-motor. Regulating valve 71 acts upon a hydraulically actuated piston-cylinder unit, generally designated 73. Piston 74 has a piston rod 75 including a toothed track 76 which engages toothed pinion gear or wheel 77 giving rise to the actual value feedback.

Piston rod 75 constitutes an output actuating rod of an electro-hydraulic booster and thus, represents the actuating shaft for each of the drives of the transport beams. The system of the electro-hydraulic booster is known.

By turning servomotor 72, which represents the rated value input, valve arrangement 71 is deflected via transverse beams 78 mounted to sleeve 79 which serves as a nut to the still stationary spindle 80 of toothed wheel 77. Such deflection opens valves 81 and 82 thereby connecting pressure supply 83 with cylinder space 74*a* and connecting cylinder space 74*b* with tank supply line 84.

Upon turning, sleeve nut 79 effects an axial displacement with respect to threaded spindle 80 which remains fixed. The developed pressure difference within cylinder 73 as noted, moves piston 74 in the direction of arrow 85. Toothed rack 75 therefor moves downwardly causing toothed wheel 77 and spindle 80 to rotate causing spindle or sleeve nut 79 to axially displace transverse beam 78 back to its original position where the regulator circuit is closed. The speed of piston 74 is proportional to the preset rated value input. External forces acting upon piston rod 75 are readjusted through this system. The rated value input, the regulating valve and the power booster are directly and operatively connected to the machine part, which is to be connected, via the toothed rack-pinion gear system.

The use of an electro-hydraulic booster as shown in FIG. 5 with the lifting beam assembly of the invention provides a lifting beam assembly which can be used universally and can operate in a more vibrationless manner and more precisely than hitherto. An essential increase in efficiency is also achieved in the transportation of workpieces from work station to work station because of the improved working intensity of the machine itself. Different workpieces can be processed on the same machine without a required rebuilding of the lifting beam assembly structure.

Further, if the drives are left with comparatively simple means, it is possible to convert the lifting beam assembly with two transport beams into an assembly with just one transport beam. The remaining lifting beam, advantageously lifting beam 11 lying at the rear of the forming press, is then equipped, instead of with gripping elements, with clamping tongs which can be actuated pneumatically or hydraulically. Such a capacity is particularly useful when transporting forged pieces with long shafts. Such workpieces generally cannot be transported in a sufficiently secure manner between the usual gripping elements used with two transport beams.

For example, if lifting beam 11 remains with stilts 26*a* and 27*a* with respective boosters 52 and 53, the two guide rods 36 connecting the respective pairs of stilts 26*a*, 26*b* and 27*a*, 27*b* to each other, are omitted. Furthermore, stilts 26*b* and 27*b*, and parallel guide rods 32*b* and 33*b* with lifting beam 12 are then omitted. Omission of these parts does not alter at all the previous systematics of the individual shaft drives and their coordination with each other. Thus, the described lifting beam assembly has a universal range of application.

While the lifting beam assembly for a forming press has been shown and described in detail, it is obvious that this invention is not to be considered as limited to the exact form disclosed, and that changes in detail and construction may be made therein within the scope of the invention without departing from the spirit thereof.

Having thus set forth and disclosed the nature of this invention, what is claimed is:

1. A lifting beam assembly for transporting workpieces from work station to work station in a forming press, said assembly comprising:

(a) support means for mounting transport beam means to the forming press for grasping workpieces to be transported within the forming press, (b) first drive means including slide member means slidably mounted on the support means for executing vertical movement to raise and lower the transport beam means, (c) second drive means including swing arm means pivotally mounted to the slide member means for executing longitudinal movement of the transport beam means in a direction parallel to the direction traveled from work station to work station, (d) third drive means mounted to swing with the swing arm means for pivotally executing transverse opening and closing movement of the transport beam means, and (e) each said drive means including movement actuating means for effecting said respective vertical, longitudinal and transverse movements, and an actuating shaft secured at one end thereof for hydraulic actuation by electro-hydraulic booster means and coupled at the other end thereof to the movement actuating means.

2. An assembly as defined in claim 1 wherein said transport beam means includes a pair of transport beam members pivotally mounted at each end thereof to stilt means pivotally mounted to said swing arm means, said movement actuating means of said third drive means including a linkage mechanism coupled to said other end of the actuating shaft for causing pivotally mounted first and second stilt means to swing back-and-forth with respect to each other causing the transport beam members to open and close with respect to each other.

3. An assembly as defined in claim 2 wherein said linkage mechanism being located at each end of said pair of transport beam members includes an extension portion and a connecting guide rod, said extension portion being located at one end of the first stilt means and connected to said other end of the actuating shaft, the connecting guide rod being coupled at one end to said extension portion on the first stilt means and coupled at the other end thereof to an intermediate point on the second stilt means whereby a swinging movement in one direction of the first stilt means causes an opposite swinging movement direction in the second stilt means.

4. An assembly as defined in claim 2 wherein said swing arm means includes a swing arm mounted to pivot about an axis of rotation extending in a direction transverse to the transport beam members, said stilt means being pivotally attached to said swing arms, and said actuating shaft of the second drive means being pivotally connected to one of the swing arms for effecting said longitudinal movement of the transport beam means when said swing arm pivots about said axis of rotation.

5. An assembly as defined in claim 4 wherein said movement actuating means of the second drive means is located at one end of the transport beam means and includes extension means attached to a swing arm located at one end of the transport beam members, said actuating shaft of said second drive means being pivotally coupled at said other end thereof to said swing arm extension means.

6. An assembly as defined in claim 1 wherein said transport beam means includes a pair of transport beam members pivotally mounted at one end thereof to stilt means pivotally mounted to said swing arm means, said slide member means of the first drive means includes a displaceable slide member for vertical movement at each end of said pair of transport beam members to raise and lower said beam members, said movement actuating means of the first drive means includes means for pivotally coupling said slide member to said other end of the actuating shaft for the electro-hydraulic booster means of said first drive means.

7. An assembly as defined in claim 1 wherein said transport beam means includes stilt means pivotally mounted to said swing arm means, said support means for mounting the transport beam means includes a mounting unit pivotally mounted to a frame structure for the forming press for providing access to the forming press and drive means when said transport beam means is disconnected from the lifting beam assembly.

8. An assembly as defined in claim 7 wherein said support means for mounting the transport beam means is removably connected to said frame structure of a forming press for interchanging said lifting beam assembly to a second forming press.

9. An assembly as defined in claim 2 wherein said linkage mechanism being located at each end of said pair of transport beam members and includes an extension portion and a connecting guide rod, said extension portion being located at one end of the first stilt means and connected to said other end of the actuating shaft, the connecting guide rod being coupled at one end to said extension portion on the first stilt means and coupled at the other end thereof to an intermediate point on the second stilt means whereby a swinging movement in one direction of the first stilt means causes an opposite swinging movement direction in the second stilt means, said swing arm means includes a swing arm located at each end of the pair of transport beam members and mounted to pivot about an axis of rotation extending in a direction transverse to the transport beam members, said stilt means being pivotally attached to said swing arms, said actuating shaft of the second drive means being pivotally connected to one of the swing arms for effecting said longitudinal movement of the transport beam means when said swing arm pivots about said axis of rotation, said slide member means of the first drive means includes a displaceable slide member for vertical movement at each end of said pair of transport beam members to raise and lower said beam members, said movement actuating means of the first drive means includes means for pivotally coupling said slide member to said other end of the actuating shaft for the electro-hydraulic booster means of said first drive means, said support means for mounting the transport beam means includes a mounting unit pivotally and removably disposed on a frame structure of the forming press at each end of the transport beam means, when said transport beam means is disconnected from the lifting beam assembly, said mounting units being removably disposed with respect to said frame structure for disposition at another frame structure for a further forming press.

10. An assembly as defined in claim 9 wherein said movement actuating means of the second drive means is located at one end of the transport beam means and includes extension means attached to a swing arm located at one end of the transport beam members, said actuating shaft of said second drive means being pivotally coupled at said other end thereof to said swing arm extension means.

11. An assembly as defined in claim 1 wherein said transport beam means includes a pair of transport beam members pivotally mounted at each end thereof to stilt means pivotally mounted to said swing arm means, at least one of said lifting beam members being capable of being equipped with clamping tongs when the other said lifting beam member has been removed.

12. An assembly as defined in claim 1 wherein said movement actuating means includes regulator means comprising a follow-up regulating valve means having an electric rated value input through an electric motor means, a hydraulic valve means, hydraulic drive means and a mechanical actual value feedback meas, and said electro-hydraulic booster means includes an output actuating shaft connected to effect each of said vertical, longitudinal and transverse movements.

13. An assembly as defined in claim 12 wherein the mechanical actual value feedback means includes movement sensing means on the output actuating shaft to sense movement of the output actuating shaft operated by the electrohydraulic booster means when the follow-up regulating valve means is open, and response means responsive to said movement sensing means to close the follow-up regulating valve means.

14. An assembly as defined in claim 13 wherein the movement sensing means includes a toothed portion on the output actuating shaft and a toothed gear engaged therewith, and the response means includes a spindle means fixed to the toothed gear to rotate therewith and cause the regulating valve means to move from an open to closed condition.

* * * * *